United States Patent [19]

Bock et al.

[11] Patent Number: 4,684,473

[45] Date of Patent: Aug. 4, 1987

[54] LUBRICANT OIL COMPOSITION WITH IMPROVED FRICTION REDUCING PROPERTIES

[75] Inventors: Jan Bock, Bridgewater; Darrell W. Brownawell, Scotch Plains; Antonio Gutierrez, Mercerville; Max L. Robbins, South Orange; Harold Shaub, Berkeley Heights; Peter L. Steyn, Madison, all of N.J.

[73] Assignee: Exxon Research and Engineering Company, Florham Park, N.J.

[21] Appl. No.: 846,007

[22] Filed: Mar. 31, 1986

[51] Int. Cl.[4] ..... C10M 125/24; C10M 129/92

[52] U.S. Cl. ..... 252/49.8; 252/56 R; 252/57

[58] Field of Search ..... 252/56 R, 57, 49.8

[56] References Cited

U.S. PATENT DOCUMENTS

| | | | |
|---|---|---|---|
| 2,531,801 | 11/1950 | Blake | 252/56 R |
| 3,102,098 | 8/1963 | Metro et al. | 252/56 R |
| 3,180,832 | 4/1965 | Furey | 252/56 R |
| 3,390,083 | 6/1968 | Lion | 252/56 R |
| 3,429,817 | 2/1969 | Furey | 252/57 |
| 4,105,571 | 8/1978 | Shaub et al. | 252/56 R |
| 4,151,102 | 4/1979 | Baur | 252/56 R |
| 4,304,678 | 12/1981 | Schick et al. | 252/56 R |
| 4,459,223 | 7/1984 | Shaub et al. | 252/56 R |

*Primary Examiner*—William R. Dixon, Jr.
*Assistant Examiner*—Ellen M. McAvoy
*Attorney, Agent, or Firm*—Richard E. Nanfeldt

[57] ABSTRACT

A lubricating oil composition having improved friction reducing properties and the method of reducing friction in internal combustion engines by lubricating said engines with said lubricating oil which contains an effective friction reducing amount of an additive which is the reaction product of dimer carboxylic acid and a polyhydric alcohol having at least 2 hydroxyl groups in combination with an oil soluble alkanol or an oil soluble alkyl phosphate.

12 Claims, No Drawings

LUBRICANT OIL COMPOSITION WITH IMPROVED FRICTION REDUCING PROPERTIES

BACKGROUND OF THE INVENTION

This invention relates to a lubricating oil composition having improved friction reducing properties and to a method for reducing friction in internal combustion engines.

There has been considerable effort in recent years to improve the fuel economy of automotive engines which operate on petroleum fuel, a product which like other forms of energy has become very expensive. Some of the known ways to improve fuel economy have been of a mechanical or design nature, such as building smaller cars and engines. Since it is known that high engine friction causes significant energy loss, another way to improve fuel economy of automotive engines is to reduce such friction.

Major efforts to reduce friction in automotive engines have involved the lubricating oils used in such engines. One approach has been to use synthetic ester base oils which are generally expensive. Another approach has been to use additives to improve the friction properties of the lubricating oil. Among the friction reducing additives which have been used are a number of molybdenum compounds, including insoluble molybdenum sulfides and organic molybdenum complexes, e.g., molybdenum amine complexes, disclosed in U.S. Pat. No. 4,164,473; molybdenum thio-bisphenol complexes disclosed in U.S. Pat. Nos. 4,192,753, 4,201,683 and 4,248,720; molybdenum oxazoline complexes, disclosed in U.S. Pat. No. 4,176074; and molybdenum lactone oxazoline complexes, disclosed in U.S. Pat. No. 4,176,073.

Another group of friction reducing additives which have been used in lubricating oils are the carboxylic acid esters. These compounds include the esters of fatty acid dimers and glycols, as disclosed in U.S. Pat. No. 4,105,571; the esters of monocarboxylic acids and glycerol, as disclosed in U.S. Pat. No. 4,304,678; the ester of dimer acids and monohydric alcohol, disclosed in U.S. Pat. No. 4,167,486; the esters of glycerol and monocarboxylic fatty acids, as disclosed in U.K. Patent Nos. 2,038,355 and 2,038,356; and esters of monocarboxylic fatty acids and polyhydric alcohols, disclosed in U.S. Pat. No. 3,933,659. U.S. Pat. No. 4,459,223 describes friction reducing agents which are the reaction product of a dimer carboxylic acid and a polyhydric alcohol. Some friction modifiers have limited solubility in lubricating oil and, therefore, limited potential for improving fuel economy. The instant invention teaches a method for improving the solubility and stability of these friction reducing agents.

While the different approaches described above all generally provide some reduced engine friction, and consequently, improved fuel economy, there is always the need and desire for further reductions in energy losses due to friction or otherwise, since even somewhat small reductions per individual engine can result in rather significant fuel savings, particularly when considering the total number of engines in use.

SUMMARY OF THE INVENTION

Now, it has surprisingly been discovered that lubricating oil compositions containing an additive of an oxygenated (hydroxy) ester of a dimer acid which has been solubilized in the lubricating oil by an oil soluble alkanol has significantly improved friction reducing properties.

More particularly, this invention is directed to a lubricating oil composition having improved friction reducing properties comprising a major amount of lubricating base oil and from about 0.1 to about 2.0 parts by weight of oxygenated (hydroxy) ester of a dimer acid solubilized and stabilized in the lubricating oil with about 0.1 to about 10 parts of an oil soluble alkanol per part of ester.

Another embodiment of this invention relates to a method of reducing friction in an internal combustion engine by lubricating said engine using a lubricating oil composition containing an effective friction reducing amount of an additive which is an oxygenated (hydroxy) ester of a dimer acid solubilized and stablized in the lubricating oil by an oil soluble alkanol.

A further embodiment of this invention relates to a method of solubilizing additives, such as friction reducers, which have low solubility in lubricating oil compositions; in particular, the use of oil soluble alkanols to solubilize into a lubricating oil friction reducers, such as an oxygenated (hydroxy) ester of a dimer acid.

DETAILED DESCRIPTION OF THE INVENTION

This invention is directed to a lubricating oil composition containing an oxygenated (hydroxy) ester of a dimer acid in combination with an oil soluble alkanol or alkyl phosphate to provide improved friction reducing properties and to a method of reducing friction in an internal combustion engine by using a lubricating oil composition which contains said additives.

The friction reducing additive which is used in this invention is an oil soluble oxygenated (hydroxy) ester of a dimer acid (HEDA hydroxy ester of dimer acid) in combination with an oil soluble alkanol or alkyl phosphate, wherein the oxygenated (hydroxy) ester is characterized by the formula:

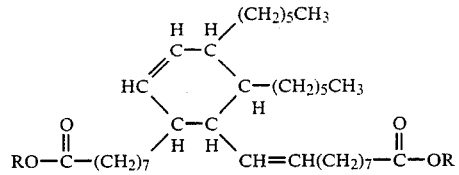

where R is selected from the group consisting of $—CH_2—CH_2—OCH_2CH_2]_nOH$; with n being equal to 1 to 5 (hereafter designated as HEDA); $—CH_2—CH_2—N(CH_2CH_2OH)_2$ (hereinafter designated as LA214); and

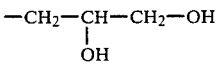

(hereinafter designated as LA200).

The use of an oxygenated (hydroxy) ester of the dimer acid as a friction-reducing agent for oils in a gasoline engine can be limited by poor solubility in the lubricating oil and adverse interactions with other lubricating oil components, wherein some of these interactions show up as sediment formation. The present invention teaches that the solubilization and stabilization of the dimer acid esters in the lubricating oils is improved by the addition of an oil-soluble alkanol or alkyl phosphate.

The oxygenated (hydroxy) esters of the dimer acid are classified as reaction products of a dimer carboxylic acid and a polyhydric alcohol. Such a reaction product may be a partial, di- or polyester, with typical formulae represented as follows when using a trihydric alcohol:

$$HO-R-OOCR''-COOH \quad (1)$$

$$HO-\left[R(OH)-OOCR''-COO\right]_n-R'(OH)-OH \quad (2)$$

wherein R'' is the hydrocarbon radical of the dimer acid; each R and R' may be the same or different hydrocarbon radicals associated with a trihydric alcohol; and n is an integer which typically is 1 to 5 or higher. It will, of course, be appreciated that the ester reaction products can be obtained by reacting a dimer carboxylic acid or a mixture of such acids with a trihydric alcohol or other polyhydric alcohol or mixtures of such alcohols.

The alcohol used in preparing the friction reducing reaction product additive of this invention is a polyhydric alcohol having at least 2 hydroxyl groups and from about 3 to about 18 carbon atoms. Generally, such compounds will be aliphatic and may contain branched or unbranched hydrocarbon groups, as well as other functional groups, such as nitrogen, sulfur and phosphorus. Such polyhydric alcohols will contain at least 2 hydroxyl groups and may contain more, generally from 3 to 6 hydroxy groups, with the upper amount limited by the degree of solubility and effectiveness of the reaction product in the lubricating oil composition. Preferably, such polyhydric alcohol will contain about 2 to 4 hydroxyl groups and about 3 to about 12 carbon atoms. More preferably, such polyhydric alcohol will be saturated, contain 3 hydroxyl groups and about 3 to about 8 carbon atoms. Compounds of this type include diethylene glycol, glycerol (i.e., 1,2,3 propane triol), 1,2,6-trihydroxyhexane and 2,2',2'' nitrilotriethanol.

The carboxylic acid used in preparing the oxygenated (hydroxy) esters of the dimer acid friction reducing reaction product of this invention will be a dimer of an aliphatic saturated or unsaturated carboxylic acid, said dimer acid having a total of about 24 to about 90 carbon atoms, and from about 9 to about 42 carbon between the carboxylic acid groups. Preferably, the dimer acid will have a total of about 24 to about 60 carbon atoms and about 12 to about 42 carbon atoms between the carboxylic acid groups, and more preferably a total of about 24 to about 44 carbon atoms and about 16 to about 22 carbon atoms between the carboxylic acid groups.

The molar quantities of the dimer acid and polyhydric alcohol reactants may be adjusted so as to secure either a complete ester or partial ester and generally from about 1 to about 3 or more moles of polyhydric alcohol will be used per mole of dimer acid and preferably from about 2 to about 3 moles of alcohol per mole of acid.

While any of the dimer acids and polyhydric alcohols described above may be used in preparing the friction reducing additive of this invention, the most preferred esters, as set forth above, are those wherein the carboxyl groups are separated from the closest carboxyl group by from about 2 to about 12 carbon atoms. Particularly useful ester additiives are obtained when the acid used is a dimer of a fatty acid, preferably those fatty acids containing about 12 to about 22 carbon atoms. Such dimers are, of course, clearly taught in U.S. Pat. No. 3,180,832, which was granted on Apr. 27, 1965, and U.S. Pat. No. 3,429,817, which was granted on Feb. 25, 1969, and as here indicated the hydrocarbon portion of the dimer carboxylic acid thus obtained may contain a 6 member ring. The formation of the dimer from linoleic acid, oleic acid and mixtures of these acids is illustrated by the following reactions:

A.

$$CH_3(CH_2)_4CH{=}CHCH_2CH{=}CH(CH_2)_7COOH \xrightleftharpoons[300^\circ\ C.]{\Delta}$$

9, 12 Linoleic Acid $$CH_3(CH_2)_5CH{=}CHCH{=}CH(CH_2)_7COOH \xrightarrow[\text{Diels-Alder}]{\text{2 molecules 9-11 acid}}$$

9, 11 Linoleic Acid

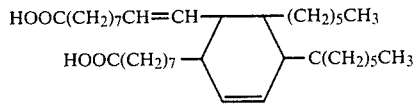

Linoleic Acid Dimer (dilinoleic acid)

B.

$$CH_3(CH_2)_7CH{=}CH(CH_2)_7COOH \xrightarrow[\text{Diels Alder}]{\text{2 molecules oleic acid}}$$

Oleic Acid $$\begin{array}{l} CH_3(CH_2)_7CH{=}C(CH_2)_7COOH \\ \quad\quad\quad\quad\quad\quad\quad\quad | \\ CH_3(CH_2)_7CH_2CH(CH_2)_7COOH \end{array}$$

Oleic Acid Dimer (Dioleic Acid)

C.

$$\text{9, 11 Linoleic Acid} + \text{Oleic Acid} \xrightarrow[\Delta]{\text{Diels Alder}}$$

$$\begin{array}{l} CH_3(CH_2)_6CHCH{=}CH(CH_2)_7COOH \\ \quad\quad\quad\quad\quad\quad | \\ CH_3(CH_2)_4CHCH{=}CHCH{=}CH(CH_2)_7COOH \end{array}$$

Mixed Dimer

It will, of course, be appreciated that while the reactions illustrated produce the dimers, commercial application of the reactions will generally also lead to trimer formation and, in some cases, the product thus obtained will contain minor amounts of unreacted monomer or monomers. As a result, commercially available dimer acids may contain as much as 25% trimer and the use of such mixtures is within the scope of the present invention. It is also noted that prepared dimer acids may be saturated or unsaturated. While in some instances the unsaturated dimer acids are preferred, it is also contemplated that if desired dimer acids formed having one or more saturated bonds may have such unsaturation removed, e.g., by hydrogenation.

The ester friction reducing additive of this invention will generally be used at a concentration level of from about 0.1 to about 2.0 parts by weight per 100 parts of lubricating oil composition, more preferably from about 0.1 to about 1.0, and most preferably from about 0.2 to about 1.0 parts.

The oil soluble alkanols which are added to the lubricating base oil and the oxygenated (hydroxy) ester of the dimer acid are:

$$RCH_2-\underset{\underset{R'}{|}}{CHOH}$$

wherein R=2–16 carbon atoms and is straight chained or branched and R′ is H or a straight or branched hydrocarbon chain containing 1 to 5 carbon atoms.

The oil-soluble alkanol will generally be used at a concentration of from about 1 to about 10 parts by weight per part of the ester friction reducing additive, more preferably about 1 to about 5, and most preferably about 2 to about 4.

The lubricating base oil will generally comprise a major amount of the lubricating composition, i.e., at least 50% by weight thereof, and will include liquid hydrocarbons, such as the mineral lubricating oils and the synthetic lubricating oils, and mixtures thereof. The synthetic oils which can be used include diester oils, such as di(2-ethylhexyl)sebacate, azelate and adipate; complex ester oils, such as those formed from dicarboxylic acids, glycols and either monobasic acids or monohydric alcohols; silicone oils; sulfide esters; organic carbonates; and other synthetic oils known in the art.

Other additives, known in the art, may be added to the oil composition of the present invention to form a finished oil. Such additives include dispersants, antiwear agents, antioxidants, corrosion inhibitors, detergents, pour point depressants, extreme pressure additives, viscosity index improvers, etc. These additives are typically disclosed, for example, in *Lubricant Additives* by C. V. Smalheer and R. Kennedy Smith, 1967, pages 1–11, and in U.S. Pat. No. 4,105,571.

DESCRIPTION OF THE PREFERRED EMBODIMENTS

The following Examples are further illustrative of this invention and are not to be construed as limitations thereof.

EXAMPLE 1

Oils A and B are fully formulated SF quality SAE 10W-30 passenger car engine oils. Each oil is formulated with standard additives used in the industry to meet the requirements of current gasoline engines. Oils A and B contain the same viscosity index improvers, dispersants, detergents, antioxidants, pour depressants and antifoamant additives. Oil A contains a zinc dialkyl dithiophosphate antiwear additive made with primary alcohols, while oil B contains a zinc dialkyl dithiophosphate antiwear additive made with secondary alcohols. This is the only difference between oils A and B.

Oil A and oil B, each formulated with 0.5 weight percent HEDA solubilized with $C_8OH$ at a 3/1 alcohol/HEDA weight ratio were tested for relative friction using a ball on cylinder test, described in the *Journal of the American Society of Lubricating Engineers,* entitled *ASLE Transactions,* Volume 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, constant rpm, and a fixed time and in each of the tests of these examples a 4 Kg load, 0.26 rpm and 70 minutes was used.

| Ball-on-Cylinder (BOC) Test Test Conditions | |
|---|---|
| Load on Ball, kg = | 4 |
| Cylinder Speed, rpm = | .26 |
| Oil Sump Temp., °C. = | 104 |
| Test Duration, Minutes = | 70 |

| BOC Coefficient of Friction (COF) at 70 Minutes (0 = Best) | | |
|---|---|---|
| Oil | Fresh Oil | After 3 Hours LST* |
| Reference | 0.260 | 0.280 |
| Oil A + HEDA/OXO$C_8$OH = $\frac{1}{3}$) | 0.050 | 0.065 |
| Reference | 0.250 | — |
| Oil B + HEDA/OXO$C_8$OH = $\frac{1}{3}$) | 0.055 | 0.070 |
| Reference | 0.220 | — |
| Oil A | 0.090 | — |
| Oil B | 0.125 | 0.105 |

*See U.S. Pat. No. 4,479,883, column 6, lines 55–60.

As summarized above, oil A and oil B, each with 0.5 weight percent HEDA and 1.5 weight percent $C_8OH$, gave lower BOC friction than the base case oils without HEDA/$C_8$ alcohol (oil A or oil B). As indicated in U.S. Pat. No. 4,479,883, the BOC data on the oxidized oil from the 3 hour Lube Stability Test (LST) is a better predictor of fuel economy differences during field service than fresh oil data.

EXAMPLE 2

Table I lists the surfactants and alcohols tested as solubilizers for dimer acid esters. The designation CO for the solubilizer refers to a series of ethoxylated nonyl phenols produced by GAF Corp. under the trademark name Igepal®. The prefix OXO refers to oil soluble alcohols manufactured by the OXO process. The designation DM refers to the Igepal DM® series of ethoxylated dinonyl phenols manufactured by the GAF Corp. Spans® are products of ICI Americas, Inc.; Tetronics® are products of BASF Wyandott Corp.; Tritons® are products of Rohm and Haas, Inc.; Aerosol® are products of American Cyanamid; and Emphos® designates a series of alkyl phosphates manufactured by Witco Chemical Corp. Of all the materials tested, only the alknanols and alkyl phosphates formed clear solutions, with HEDA in oil A at the ratios of solubilzer/ester indicated in the second column of Table I.

TABLE I

| Solubilization of Dimer Acid Esters | | | | | |
|---|---|---|---|---|---|
| CONCENTRATES | | | OILS PLUS CONCENTRATES | | |
| Solubilizer/Additive | Ratio | Appearance(1) | S150N | Oil A | Oil B |
| $C_9$Phenol/HEDA | 2:1,4:1 | 1, 1 | —, 2 | 4, 3 | 5, 3 |
| CO210/HEDA | 2:1,4:1 | 1, 1 | —, 3 | 3, 2 | 5, 2 |
| CO430/HEDA | 2:1,4:1 | 1, 1 | —, — | 3, 3 | 5, 3 |
| CO530/HEDA | —,4:1 | —, 1 | —, 5 | —, 4 | —, 4 |

TABLE I-continued

| Solubilization of Dimer Acid Esters | | | | | |
|---|---|---|---|---|---|
| CONCENTRATES | | | OILS PLUS CONCENTRATES | | |
| Solubilizer/Additive | Ratio | Appearance[1] | S150N | Oil A | Oil B |
| CO630/HEDA | —,4:1 | —, 1 | —, 5 | —, 5 | —, 5 |
| CO710/HEDA | —,4:1 | —, 1 | —, 5 | —, 5 | —, 5 |
| $C_9$Phenol/LA200 | 2:1,4:1 | 1, 1 | —, — | 5, 5 | 5, 5 |
| CO210/LA200 | 2:1,4:1 | 1, 1 | —, — | 5, 5 | 5, 5 |
| CO430/LA200 | 2:1,4:1 | 1, 1 | —, — | 5, 5 | 5, 5 |
| $C_9$Phenol/LA214 | 2:1,4:1 | 1, 1 | —, — | 5, 5 | 5, 5 |
| CO210/LA214 | 2:1,4:1 | 1, 1 | —, — | 5, 5 | 5, 5 |
| CO430/LA214 | 2:1,4:1 | 1, 1 | —, — | 5, 5 | 5, 5 |
| OXO$C_6$OH/HEDA | 2:1,3:1,4:1 | 1, 1, 1 | —, —, — | 1, 1, 1 | 2, 1, 1 |
| OXO$C_8$OH/HEDA | 2:1,3:1,4:1 | 1, 1, 1 | —, —, — | 1, 1, 1 | 2, 2, 1 |
| OXO$C_{13}$OH/HEDA | —, —,4:1 | —, —, 1 | —, —, 2 | —, —, 2 | —, —, 2 |
| OXO$C_6$OH/LA200 | 2:1,3:1,4:1 | 1, 1, 1 | —, —, — | 5, 5, 5 | 5, 5, 5 |
| OXO$C_8$OH/LA200 | ,—,—,4:1 | —, —, 1 | —, —, — | —, —, 5 | —, —, 5 |
| OXXO$C_{10}$OH/LA200 | 2:1,3:1,4:1 | 1, 1, 1 | —, —, — | 5, 5, 5 | 5, 5, 5 |
| OXO$C_{13}$OH/LA200 | 2:1,3:1,4:1 | 1, 1, 1 | —, —, — | 5, 5, 5 | 5, 5, 5 |
| OXO$C_6$OH/LA214 | 2:1,3:1,4:1 | 1, 1, 1 | —, —, — | 5, 5, 5 | 5, 5, 5 |
| OXO$C_8$OH/LA214 | 2:1,3:1,4:1 | —, —, 1 | —, —, — | 5, 5, 5 | 5, 5, 5 |
| OXO$C_{10}$OH/LA214 | 2:1,3:1,4:1 | 1, 1, 1 | —, —, — | 5, 5, 5 | 5, 5, 5 |
| OXO$C_{13}$OH/LA214 | 2:1,3:1,4:1 | 1, 1, 1 | —, —, — | 5, 5, 5 | 5, 5, 5 |
| $C_8$OH/HEDA | 2:1,3:1,4:1 | 1, 1, 1 | —, —, — | 5, —, 1 | —, —, — |
| $C_8$OH/LA200 | 2:1,3:1,4:1 | 1, 1, 1 | —, —, — | 5, 5, 5 | —, —, — |
| $C_8$OH/LA214 | 2:1,3:1,4:1 | 1, 1, 1 | —, —, — | 5, 5, 5 | —, —, — |
| OXO$C_8$ACET/HEDA | 4:1 | 1 | 3 | 4 | 4 |
| OXO$C_9$ACET/HEDA | 2:1,3:1 | 1, 1 | 2, 2 | —, — | —, — |
| OXO$C_{13}$ACET/HEDA | 4:1 | 1 | 1 | 5 | 5 |
| OXO$C_9$ACET/LA200 | 2:1,3:1 | 5, 4 | 5, 5 | —, — | —, — |
| OXO$C_9$ACET/LA214 | 2:1,3:1 | 5, 4 | 5, 5 | —, — | —, — |
| DM430/HEDA | 4:1 | 1 | 5 | 3 | |
| DM530/HEDA | 4:1 | 1 | 5 | 4 | 4 |
| DM710/HEDA | 4:1 | 1 | 5 | 5 | 5 |
| OXO$C_8$OH/(HEDA/LA200) | | | | | |
| = (95/5) | 4:1 | — | — | 1 | — |
| = (90/10) | 4:1 | — | — | 1 | — |
| = (85/15) | 4:1 | — | — | 2 | — |
| = (80/20) | 4:1 | — | — | 3 | — |
| = (75/25) | 4:1 | — | — | 4 | — |
| = (70/30) | 4:1 | — | — | 5 | — |
| = (60/40) | 4:1 | — | — | 5 | — |
| = (50/50) | 4:1 | — | — | 5 | — |
| Butyl Cellulose/LA200 | 4:1 | 1 | — | 5 | — |
| Oleic Acid/LA200 | 4:1 | 1 | — | 5 | — |
| Span 80/LA214 | 4:1 | 1 | — | 5 | — |
| Span 85/LA214 | 4:1 | 1 | — | 5 | — |
| Tetronic 1501/LA214 | 4:1 | 5 | — | — | — |
| Tetronic 6101/LA214 | 4:1 | 5 | — | — | — |
| Triton X-15/LA214 | 4:1 | 1 | — | 5 | — |
| Aerosol MA80/LA200 | 4:1 | 1 | — | 5 | — |
| Siloxane/LA200 | 4:1 | 5 | — | — | — |
| Emphos PS121/HEDA | 4:1 | 1 | — | 1 | — |
| Emphos PS220/HEDA | 4:1 | 1 | — | 1 | — |
| Emphos CS1361/HEDA | 4:1 | 1 | — | 1 | — |
| Emphos CS1361/LA200 | 4:1 | 1 | — | 5 | — |
| Emphos PS220/LA200 | 4:1 | 1 | — | 5 | — |
| Emphos PS121/LA200 | 4:1 | 1 | — | 5 | — |

[1]1-Excellent; 2-Very good; 3-Good; 4-Fair; 5-Poor. The friction reducing dimer acid product is used in all cases at the 0.5 weight percent level.

EXAMPLE 3

A series of alkanols, including $C_6$, $C_8$ and $C_{13}$, were used as solubilization agents with HEDA in lubricating oils A and B. Shown in Table II is the appearance of the oils using 0.5 weight percent HEDA solubilized by the alkanols. As illustrated, solubilization of HEDA in oil B requires more alkanol than required by oil A to obtain a bright and clear oil. To test the stability of these systems, oil A, containing 0.5 weight percent of HEDA, solubilized with 3 parts of $C_8$OH per part of HEDA was stored two months at 22° C. with no apparent change. In addition, this oil was temperature cycled for one-half hour at 100° C., one and one-half hours at −14° C., one-half hour at −40° C. and one hour at 100° C. with no apparent change in clarity. Also indicated is the criticality of the chain length in the alkanol. $C_{13}$OH is less effective in solubilizing HEDA in both oil A and oil B relative to $C_8$OH and $C_6$OH.

TABLE II

| Solubilization of 0.5 Wt. % HEDA by Oxo-Alcohols | | | | |
|---|---|---|---|---|
| | | Alcohol | Appearance[1] | |
| Alcohol | B.P. °C. | Ester Ratio | Oil A | Oil B |
| $C_6$OH | 151° | 2/1 | 1 | 2 |
| | | 3/1 | 1 | 1 |
| | | 4/1 | 1 | 1 |
| $C_8$OH | 183° | 2/1 | 1 | 2 |
| | | 3/1 | 1 | |
| | | 4/1 | 1 | 1 |
| $C_{13}$OH | 260° | 4/1 | 2 | 2 |

[1]1-Bright and Clear; 2-Clear

What is claimed is:

1. A lubricating oil composition having improved friction reducing properties comprising:

(a) a major amount of a lubricating base oil;

(b) from about 0.1 to about 2.0 parts by weight of the reaction product of a dimer carboxylic acid having a total of about 24 to about 90 carbon atoms with about 9 to about 42 carbon atoms between carboxylic acid groups and a polyhydric alcohol having at least 3 to about 18 carbon atoms per 100 parts by weight of said lubricating oil composition, said reaction product being formed using from about 1 to about 3 moles of alcohol per mole of dimer acid; and (c) from about 1 to about 10 parts by weight of an oil soluble compound per part of the reaction product of (b) wherein said oil soluble compound solubilizing the reaction product of (b) in said lubricating base oil and said oil soluble compound is selected from the group consisting of alkanols and alkyl phosphates, said alkyl phosphate being characterized by the formula:

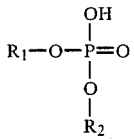

wherein $R_1$ is an alkyl or alkyl aryl group of 6–18 carbons on the alkyl chain and $R_2$ is the same as $R_1$ or H.

2. The composition of claim 1 wherein said dimer carboxylic acid has about 24 to about 60 carbon atoms and said polyhydric alcohol has about 3 to about 12 carbon atoms.

3. The composition of claim 2 wherein from about 0.1 to about 1.0 parts by weight of said reaction product is used.

4. The composition of claim 3 wherein said polyhydric alcohol is selected from the group consisting of diethylene glycol, glycerol, 1,2,6 trihydroxyhexane and 2,2′,2″ nitrilotriethanol.

5. The composition of claim 1 wherein from about 0.1 to about 1.0 parts by weight of said reaction product is used and said polyhydric alcohol is selected from the group consisting of diethylene glycol, glycerol, 1,2,6 trihydroxyhexane and 2,2′,2″ nitrilotriethanol.

6. The composition of claim 1 wherein said alkanol is characterized by the formula:

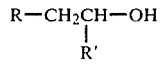

where R=2–16 carbon atoms and can be linear or branched and R′ is H or a straight or branched hydrocarbon chain containing 1 to 5 carbon atoms.

7. A method of reducing friction in an internal combustion engine comprising lubricating said engine using a lubrication oil composition containing an effective friction reducing amount of an additive which is the reaction product of a dimer carboxylic acid having about 24 to about 90 carbon atoms and a polyhdric alcohol having at least 2 hydroxyl groups and about 3 to about 18 carbon atoms, in combination with an oil soluble compound selected from the group consisting of alkanols and alkyl phosphates wherein said alkanol is characterized by the formula:

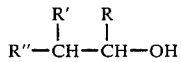

where R, R′ and R″ can be H or branched $CH_3$, $CH_3CH_2$, $CH_3(CH_2)$, etc., such that the total of R, R′ and R″ $=C_2$ to $C_{14}$ and said alkyl phosphate is characterized by the formula:

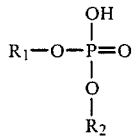

wherein $R_1$ is an alkyl or alkyl aryl group of 16–18 carbons on the alkyl chain and $R_2$ is the same as $R_1$ or H.

8. The method of claim 7 wherein from about 0.1 to about 2.0 parts by weight of said additive reaction product is used per 100 parts by weight of said lubricating oil composition.

9. The method of claim 8 wherein said dimer carboxylic acid contains about 9 to about 42 carbon atoms between carboxylic acid groups and said reaction product is formed using from about 1 to about 3 moles of polyhydric alcohol per mole of dimer acid.

10. The method of claim 1 wherein said polyhydric alcohol is selected from the group consisting of diethylene glycol, glycerol, 1,2,6 trihydroxyhexane and 2,2′,2″ nitrilotriethanol.

11. The method of claim 10 wherein said dimer carboxylic acid is the dimer of linoleic acid, oleic acid or mixtures thereof.

12. The method of claim 7 wherein from about 1 to about 10 parts by weight of said oil-soluble compound is used per part by weight of said friction reducing additive wherein from about 0.1 to about 1.0 parts by weight is used per 100 parts by weight of said lubricating oil composition.

* * * * *